US009583239B2

(12) United States Patent
Xu et al.

(10) Patent No.: US 9,583,239 B2
(45) Date of Patent: Feb. 28, 2017

(54) ELECTRODE COMPONENT WITH ELECTRODE LAYERS FORMED ON INTERMEDIATE LAYERS

(71) Applicant: THINKING ELECTRONIC INDUSTRIAL CO., LTD., Kaohsiung (TW)

(72) Inventors: Xun Xu, Kaohsiung (TW); Jen-Heng Huang, Kaohsiung (TW); Zhiwei Jia, Kaohsiung (TW)

(73) Assignee: THINKING ELECTRONIC INDUSTRIAL CO., LTD., Kaohsiung (TW)

( * ) Notice: Subject to any disclaimer, the term of this patent is extended or adjusted under 35 U.S.C. 154(b) by 5 days.

(21) Appl. No.: 14/645,905

(22) Filed: Mar. 12, 2015

(65) Prior Publication Data

US 2016/0035466 A1 Feb. 4, 2016

(30) Foreign Application Priority Data

Jul. 31, 2014 (CN) ..... 2014 1 0375413

(51) Int. Cl.
*H01C 1/14* (2006.01)
*H01C 7/10* (2006.01)
(Continued)

(52) U.S. Cl.
CPC ..... *H01C 1/14* (2013.01); *H01C 1/142* (2013.01); *H01C 7/10* (2013.01); *H01C 7/102* (2013.01);
(Continued)

(58) Field of Classification Search
CPC ..... H01C 1/14; H01C 1/142
See application file for complete search history.

(56) References Cited

U.S. PATENT DOCUMENTS 4,831,432 A * 5/1989 Hori ..... H01C 1/1406 257/43
6,005,474 A * 12/1999 Takeuchi ..... H01C 1/142 29/620
(Continued)

FOREIGN PATENT DOCUMENTS

CN 102503580 A 6/2012
CN 102800475 A 11/2012
(Continued)

*Primary Examiner* — James Harvey
(74) *Attorney, Agent, or Firm* — Rabin & Berdo, P.C.

(57) ABSTRACT

An electrode component with electrode layers formed on intermediate layers includes a ceramic substrate, two intermediate layers formed on two opposite surfaces of the ceramic substrate, two electrode layers respectively formed on the two intermediate layers, two lead wires respectively connected to the electrode layers, and an insulating layer enclosing the ceramic substrate, the intermediate layers, the electrode layers, and portions of the two lead wires. The intermediate layer formed between the ceramic substrate and the electrode layer replaces the fabrication means for conventional silver electrode layer to provide good binding strength between the ceramic substrate and the electrode layer. Besides same electrical characteristics for original products, the electrode component can get rid of the use of precious silver in screen printed silver electrode and avoid pollution caused by evaporation and thermal dissolution of organic solvent while lowering the ohmic contact resistance between the electrode layer and the ceramic substrate.

10 Claims, 5 Drawing Sheets

(51) Int. Cl.

| | |
|---|---|
| ***H01C 1/142*** | (2006.01) |
| ***H01C 7/102*** | (2006.01) |
| ***H01C 17/28*** | (2006.01) |
| *H01C 1/144* | (2006.01) |

(52) U.S. Cl.
CPC ..... *H01C 17/285* (2013.01); *H01C 1/144* (2013.01); *H01C 17/281* (2013.01); *H01C 17/288* (2013.01)

(56) References Cited

U.S. PATENT DOCUMENTS

| | | | | |
|---|---|---|---|---|
| 6,522,237 | B1 * | 2/2003 | Ito | H01C 1/1406 338/22 R |
| 2007/0035378 | A1 * | 2/2007 | Wang | H01C 7/027 338/22 R |
| 2014/0339955 | A1 * | 11/2014 | Tseng | H01G 4/252 310/311 |
| 2016/0035466 | A1 * | 2/2016 | Xu | H01C 1/14 338/20 |
| 2016/0086699 | A1 * | 3/2016 | Huang | H01C 1/142 338/21 |

FOREIGN PATENT DOCUMENTS

| | | | |
|---|---|---|---|
| CN | 103247362 | A | 8/2013 |
| CN | 103400675 | A | 11/2013 |
| CN | 203415335 | U | 1/2014 |
| CN | 104299738 | A | 1/2015 |
| CN | 204257308 | U | 4/2015 |
| DE | 3638286 | A1 | 5/1988 |
| JP | 2002-373801 | A | 12/2002 |

* cited by examiner

ELECTRODE COMPONENT WITH ELECTRODE LAYERS FORMED ON INTERMEDIATE LAYERS

BACKGROUND OF THE INVENTION

1. Field of the Invention

The present invention relates to an electrode component, and more particularly, to an electrode component with electrode layers formed on intermediate layers.

2. Description of the Related Art

A varistor is an electronic component mainly formed by zinc oxide powder and mixed with bismuth oxide, antimony oxide, manganese oxide and the like diffused to grain boundaries of zinc oxide. After the mixture is molded by a dry press process, organic binder is removed from the mixture and a ceramic resistor with nonlinear characteristics is generated from the molded mixture using a high-temperature sintering process.

The conductive electrode layer of a conventional varistor is usually formed by the silk-screen printing technique. During fabrication of the electrode layer, a ceramic chip with organic silver paste having a weight percent range of silver 60~80% attached thereto is processed using a sintering process in a temperature range of 600~900° C. for the organic silver paste to form a desired electrode layer. The thickness of the electrode layer is normally maintained in a range of 6~15 μm for soldering and product reliability. However, conventional silk-screen printing process has the following drawbacks and deficiencies.

1. Lots of toxic substances contained in the organic silver paste cause serious environmental pollution.

2. High production cost arises from the use of a great deal of precious silver material. To increase the surge-withstanding capability of the varistor, a thick silver layer is inevitably adopted, and the thickness of the silver layer is oftentimes more than 15 μm.

The varistor with silver electrode fabricated using the conventional silk-screen printing process has the following shortcomings.

1. Low bonding strength due to the silver-ceramic incompatibility. The bonding strength is increased mainly through the glassy substance in the organic silver paste diffused to the grain boundaries of ceramic, such that the bonding strength between the silver electrode layer and the ceramic substrate is not satisfactory.

2. High-resistance ohmic contact.

3. Poor corrosion resistance of the silver electrode layer against lead-free solder. As the solid solubility of silver and tin is relatively high, solder can easily etch a silver layer at a high temperature. Nowadays, owing to the concern of environmental protection, products are manufactured using the lead-free soldering technique. To avoid pseudo soldering and melting silver, the 3Ag solder indicative of a Sn—Ag—Cu solder alloy with a higher silver content at a weight percentage of silver 3% is used for soldering and thus becomes a cost-down barrier of products. Meanwhile, because of the high mutual solubility of tin and silver in a lead-free solder, after products are powered on and operated for a long time, the silver electrode layer can be easily etched by the solder, such that the electrode has a reduced adhesion force and even becomes detached. Therefore, once the electrode becomes detached, transportation equipment, such as vehicles, using such type of varistor could be in a dangerous situation.

To lower production cost of the varistors, as disclosed in China Patent Application No. 201310177249.5, entitled "Base metal combination electrode of electronic ceramic element and preparation method therefor", the drawback of the electrode of the varistor fabricated using a technique of hot-spraying multiple layers of base metal resides in that upon a high-voltage discharge current gives rise to high heat at metal electrode interfaces and the metal electrode interfaces could be easily separable, hindering durability and reliability of products.

SUMMARY OF THE INVENTION

An objective of the present invention is to provide an electrode component with electrode layers formed on intermediate layers whose electrode is not necessarily formed by organic silver paste.

To achieve the foregoing objective, the electrode component with electrode layers formed on intermediate layers includes a ceramic substrate, two intermediate layers, two electrode layers, two lead wires, and an insulating layer.

The ceramic substrate has two opposite surfaces.

The two intermediate layers are respectively formed on the two opposite surfaces of the ceramic substrate. Each intermediate layer is formed by a metal material selected from one of nickel, vanadium, chromium, aluminum, and zinc or a combination thereof.

The two electrode layers are respectively formed on the two intermediate layers.

Each lead wire has a top portion connected to one of the two electrode layers.

The insulating layer encloses the ceramic substrate, the two electrode layers, and the top portions of the two lead wires.

After the intermediate layers are formed on the opposite surfaces of the ceramic substrate, the electrode layers are further respectively formed on the intermediate layers to enhance ohmic contact resistance and binding strength between the electrode layers and the ceramic substrate.

The electrode component has the following advantages.

1. No use of precious silver as required in the conventional screen printed silver electrode and good solder erosion protection.

2. No pollution generation caused by evaporation and thermal dissolution of organic solvent.

3. Enhanced ohmic contact resistance between the electrode layers and the ceramic substrate capable of reducing heat generation, prolonging operation duration, and upgrading electrical characteristics of the electrode component.

Other objectives, advantages and novel features of the invention will become more apparent from the following detailed description when taken in conjunction with the accompanying drawings.

DETAILED DESCRIPTION OF THE INVENTION

Figure 1A:
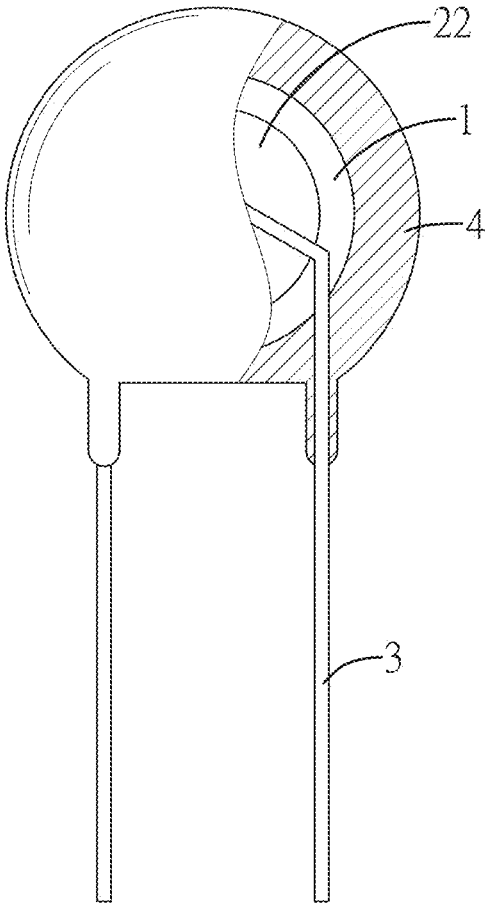
FIG. 1A is a schematic front view in partial section of an electrode component with electrode layers formed on intermediate layers in accordance with the present invention.
Figure 1B:
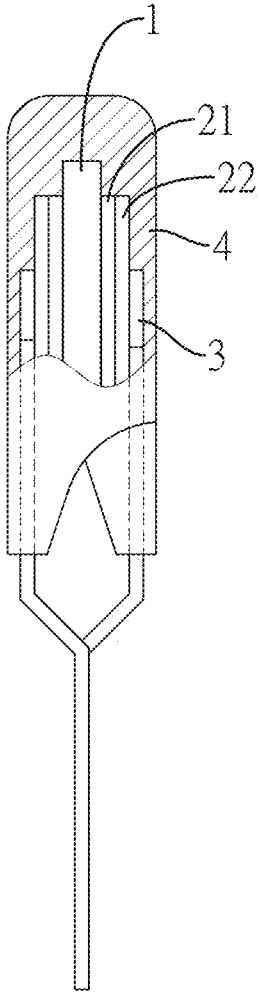
FIG. 1B is a schematic side view in partial section of the electrode component in FIG. 1.

With reference to FIGS. 1A and 1B, an electrode component with electrode layers formed on intermediate layers in accordance with the present invention includes a ceramic substrate 1, two intermediate layers 21, two electrode layers 22, two lead wires 3, and an insulating layer 4.

The two intermediate layers 21 are respectively formed on two opposite surfaces of the ceramic substrate 1. The two electrode layers 22 are respectively formed on the two intermediate layers 21. The two lead wires 3 are respectively connected to the two electrode layers 22. The insulating layer 4 encloses the ceramic substrate 1, the intermediate layers 21, the electrode layers 22 and a portion of each lead wire 3.

Figure 2:
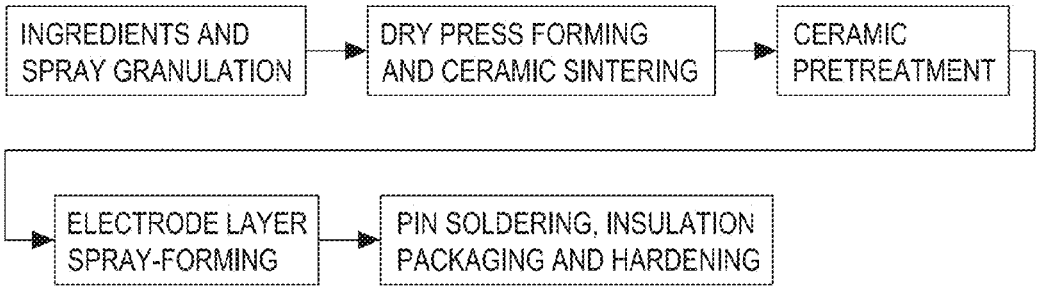
FIG. 2 is a flow diagram of a method for fabricating a varistor.

With reference to FIG. 2, a method for fabricating an electrode component is shown. Given the electrode component as a varistor, the method includes processes of spray granulation, dry press forming and ceramic sintering, which are known as conventional techniques and are not repeated here. After the ceramic substrate 1 is made, a surface treatment process mainly involved with the present invention is applied to the ceramic substrate 1 to form the intermediate layers on the ceramic substrate 1. A process of spray-forming the electrode layers 22 and subsequent processes for pin soldering, insulation packaging, hardening and the like are described in details as follows.

Figure 3:
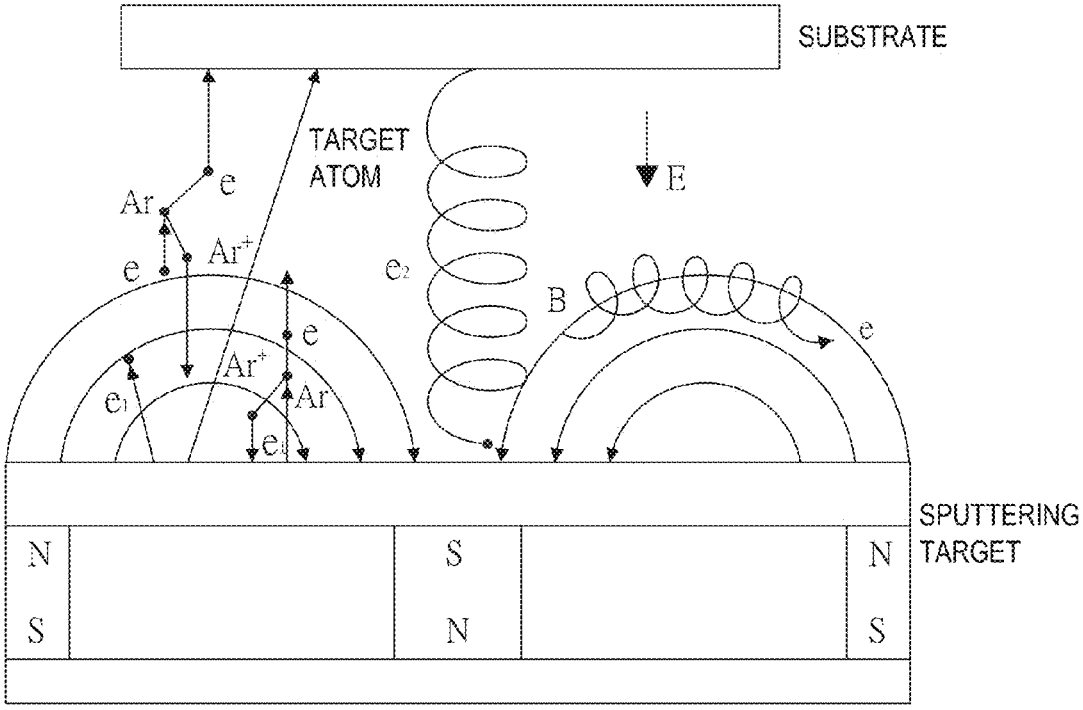
FIG. 3 is a schematic view of sputtering.
Figure 4:
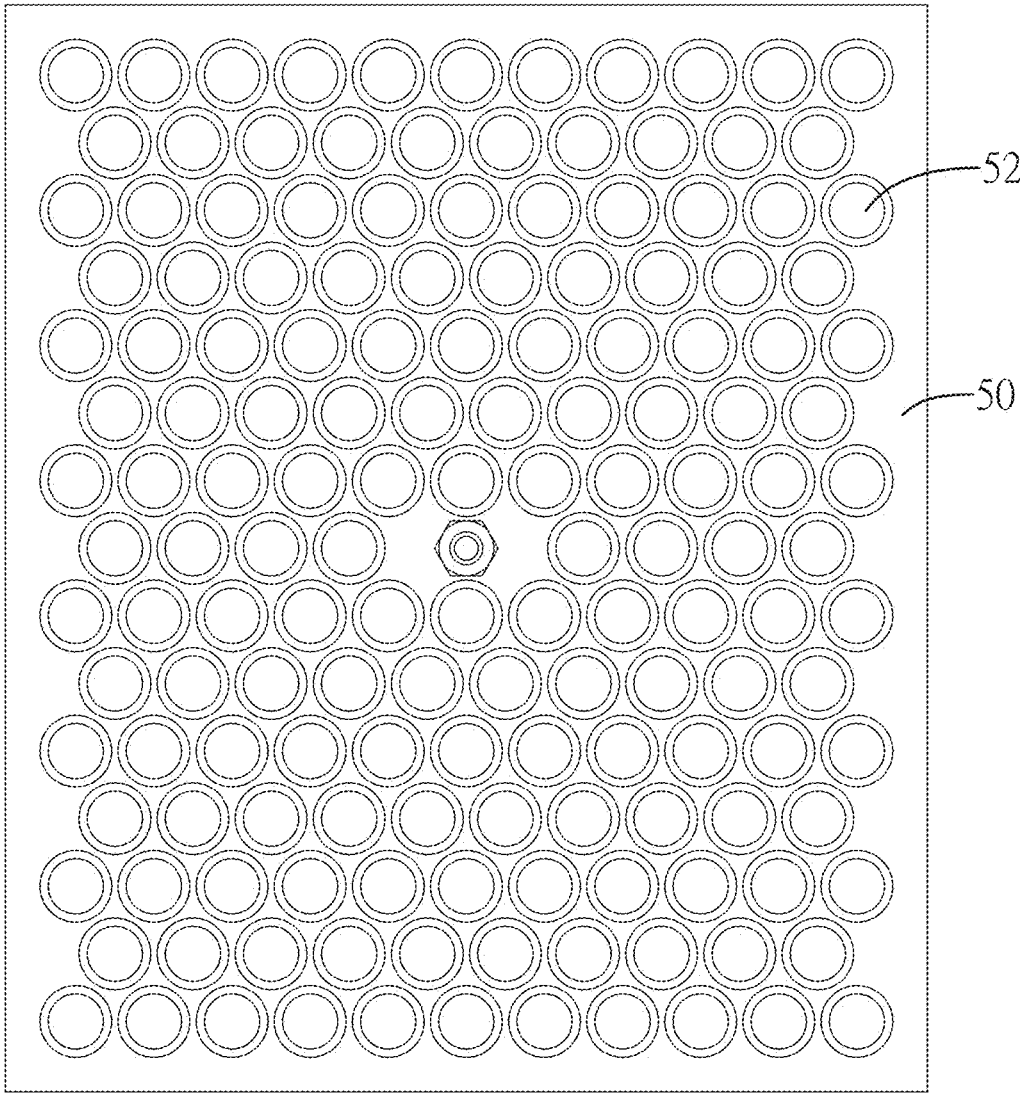
FIG. 4 is a schematic view of a fixture for sputtering with multiple openings in accordance with the present invention.

The intermediate layers 21 are formed by a sputtering process to deposit a metal material on the opposite surfaces of the ceramic substrate 1. The metal material used in the sputtering process is selected from one of nickel, vanadium, chromium, aluminum, and zinc or a combination thereof. With reference to FIG. 3, a schematic view of sputtering is shown. As being conventional techniques, the details about the sputtering concepts are not repeated here. With reference to FIG. 4, after cleaned, the ceramic substrate 1 is placed behind a sputtering mask 50. The sputtering mask 50 is built with aluminum material, stainless steel or other high polymer material with high heat resistance, and has multiple openings 52 formed through the sputtering mask 50 for portions of the ceramic substrate 1 to be exposed through the multiple openings 52 as the areas to be sputtered. The form of the areas to be sputtered depends upon the shape of the electrode component to be produced. In the present embodiment, the form of the areas is chosen to be round.

Figure 5:
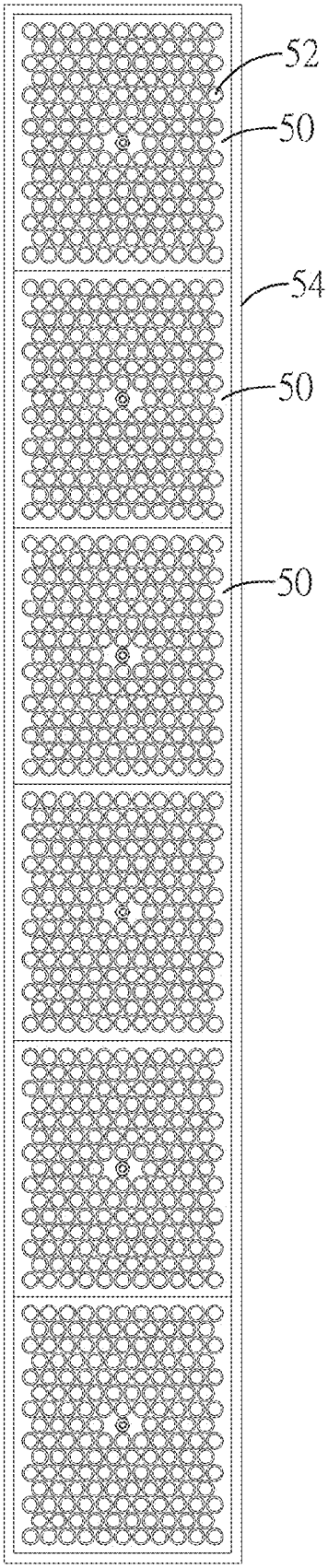
FIG. 5 is a schematic view of a work piece stand for sputtering.

With reference to FIG. 5, multiple sputtering masks 50 and multiple ceramic substrates 1 respectively placed behind the multiple sputtering masks 50 can be placed on a work piece stand in a sputtering chamber. Multiple work piece stands 54 can be simultaneously arranged inside vacuum magnetron sputtering equipment and the sputtering can be started. The vacuum magnetron sputtering equipment may be one-chamber, two-chamber or continuous inline sputtering equipment, and the target may be a planar target or a cylindrical target. Prior to the sputtering, the sputtering power and the sputtering time for each target are configured. The sputtering equipment then starts vacuuming with degree of vacuum in a range of −0.02~0.08 MPa. Inert gas is further added to the sputtering chamber. The inert gas may be Argon, and has a flow rate in a range of 45~50 ml/s. After the sputtering lasts for 10 to 30 minutes, each intermediate layer 21 can be coated by the vacuum magnetron sputtering to have a thickness approximately in a range of 0.1~0.5 μm.

As chemical compatibility between the ceramic substrate 1 and each of nickel, vanadium, chromium, aluminum, and zinc is high, a low-resistance ohmic contact can be formed therebetween with a significantly small sheet resistance (ohm per unit area). Because of the reduced ohmic contact, heat generated by surge current can thus be lessened to prevent the electrode layers 22 from being burned out and damaged by high heat. Also because of no organic silver paste used in the electronic component of the present invention, the electronic component is advantageous in higher solder erosion resistance, such that products having the electronic component of the present invention soldered thereto can avoid solder erosion and therefore prolong life duration of the products.

After the intermediate layers 21 are formed, the process of spray-forming the electrode layers 22 can be started. The electrode layers 22 are respectively sprayed on the intermediate layers 21. The electrode layers 22 can be formed by a metal material selected from one of zinc, copper, tin, and nickel or a combination thereof. The two electrode layers 22 are simultaneously formed by electric arc spray or flame spray. The work piece stands pass through continuous spray chambers in a tunnel, and the process of spray-forming the electrode layers 22 can be done in approximately 2 to 10 seconds depending on parameter setting at each station.

The process of spray-forming the electrode layers has the following steps.

Step 1: Place the treated ceramic substrate 1 on a work piece stand into a continuous arc spray machine or a flame spray machine.

Step 2: Apply continuous spraying equipment with multiple spray nozzles for multiple processes at different spray stations to directly spray a surface of each intermediate layer 21. Each spray nozzle sprays one metal or an alloy of a desired metal material.

Step 3: Set up spray voltage in a range of 20~35V, spray current in a range of 100~200 A, spray air pressure at 0.5 Mpa, spray time in a range of 2~5 seconds, and spray thickness in a range of 5~10 μm for each spray station.

After the electrode layers 22 are formed, the two electrode layers 22 are soldered to the two respective lead wires 3. The ceramic substrate 1, the intermediate layers 21, the electrode layers 22, and the lead wires 3 are enclosed by the insulation layer 4, which may be formed by epoxy, to form the electrode component with the lead wires 3 partially exposed. Electrical characteristics of the electrode component are further tested.

The electrode component in accordance with the present invention may be applied to one of metal oxide varistor (MOV), gas sensitive resistor, PTC (Positive temperature coefficient) thermistor, NTC (Negative temperature coefficient) thermistor, piezoelectric ceramic, and ceramic capacitor. The shape of the electrode component may be square, round, oval, tubular, cylindrical or pyramidal. Given a MOV as an example, a surge withstand capability (Imax) of the electronic component in the MOV against combination wave increases about 50%. The following table shows comparison between the varistors using conventional silver electrode and the varistors using the electrode component of the present invention.

| Material of electrode | Film thickness | Varistor voltage | Imax (KA, 8/20 μs) | No. of combo. wave (6 KV/3 KA) withstood before failure |
|---|---|---|---|---|
| Printed Ag | 8.6 | 495.6 | 4.5 | 34 |
| Printed Ag | 15.4 | 472.3 | 6 | 65 |
| Sputtered Ni; sprayed Zn | 6.5 | 490.0 | 6 | 60 |
| Sputtered Cr; sprayed Cu | 5.8 | 491.9 | 6 | 120 |
| Sputtered Ni; Sprayed Sn | 7.2 | 484.6 | 6.5 | 124 |

As shown in the second and third rows of the above table, to withstand the impact of large transient energy, conventional varistor adopts the means of printed silver electrode to form a thicker electrode layer (Ag) for current density distribution. If the requirement of surge withstand capability (Imax) is 6 KV, the thickness of the silver electrode layer is normally 16 μm and more.

Figure 6:
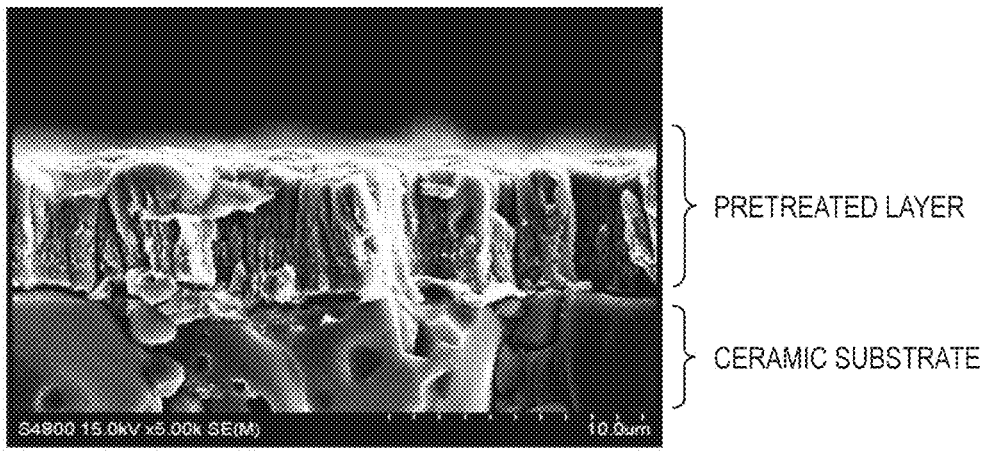
FIG. 6 is a photomicrograph of an intermediate layer in accordance with the present invention.
Figure 7:
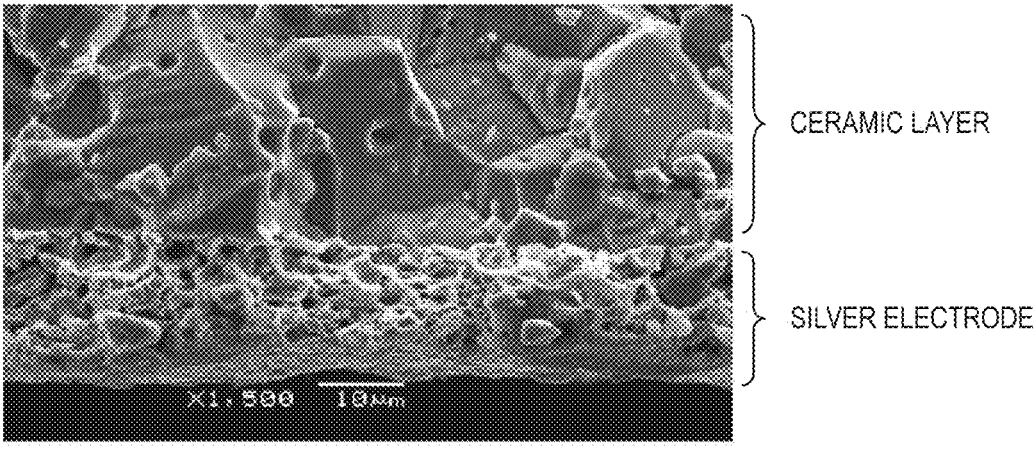
FIG.7 PRIOR ART
FIG. 7 is a photomicrograph of a conventional silver electrode.

As for the fourth to sixth rows of the above table, a total thickness of the electrode layer 22 and the sputtered intermediate layer 21 of the electrode component in the present invention for lowering ohmic contact resistance and electrode erosion caused by solder is under 10 μm. When the conventional silver electrode as shown in FIG. 7 is compared with the intermediate layer 21 of the present invention as shown in FIG. 6, the single-layer screen printed silver electrode has a loose structure with lots of large cavities formed therein while the sputtered intermediate layer 22 of the present invention has a more compact structure with smaller cavities. Furthermore, as indicated in the third and fourth rows of the above table, under the same surge withstand capability (6 KA), a total thickness of the sputtered Ni for the intermediate layer 21 and the sprayed Zn for the electrode layer 22 is just 6.5 μm. In contrast to the thickness of the conventional screen printed silver electrode, which is 15.4 μm, the total thickness of the present invention is greatly reduced. As far as the number of combination wave (6 KV/3 KA) testing the varistors at 90 degrees phase angle and withstood by the varistors for 60 seconds before failure of the varistors is concerned, the number is from 35 to 65 for the varistors using the conventional silver electrode while the number is 100 to 120 for the varistors using the electrode component of the present invention, which almost doubles that for the varistors using the conventional silver electrode.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An electrode component with intermediate layers, comprising:

a ceramic substrate having two opposite surfaces;

two intermediate layers respectively formed on the two opposite surfaces of the ceramic substrate, each intermediate layer formed by a metal material selected from one of nickel, vanadium, chromium, aluminum, and zinc or a combination thereof;

two electrode layers respectively formed on the two intermediate layers;

two pins, each pin having a top portion connected to one of the two electrode layers; and an insulating layer enclosing the ceramic substrate, the two electrode layers, and the top portions of the two pins, wherein the electrode layers are formed by a spray-forming process, and a thickness of each electrode layer is in a range of 5 to 20 μm.

2. The electrode component as claimed in claim 1, wherein the intermediate layers are formed by a sputtering process.

3. The electrode component as claimed in claim 1, wherein a thickness of each intermediate layer is in a range of 0.1 to 0.5 μm.

4. The electrode component as claimed in claim 2, wherein a thickness of each intermediate layer is in a range of 0.1 to 0.5 μm.

5. The electrode component as claimed in claim 3, wherein the electrode layers are formed by a metal material selected from one of zinc, copper, tin, and nickel or a combination thereof.

6. The electrode component as claimed in claim 4, wherein the electrode layers are formed by a metal material selected from one of zinc, copper, tin, and nickel or a combination thereof.

7. An electrode component comprising:

a ceramic substrate with two surfaces opposite to each other;

two intermediate layers disposed on the two surfaces by a sputtering process with a metal material so that the metal material forms the intermediate layers, the metal material being selected from one of nickel, vanadium, chromium, aluminum, and zinc or a combination of nickel, vanadium, chromium, aluminum, and zinc, wherein a reduced ohmic contact is formed between each intermediate layer and the ceramic substrate;

two electrode layers respectively formed on the two intermediate layers by a spray-forming process with another metal material so that the two electrode layers include the another metal material, the another metal material selected from one of zinc, copper, tin, and nickel or a combination of zinc, copper, tin, and nickel;

a lead wire connected to each electrode layer; and an insulating layer enclosing the ceramic substrate, the two electrode layers, and top portions of the two lead wires.

8. A method for fabricating an electrode component with two electrode layers formed on two intermediate layers, the method comprising steps of:

preparing a ceramic substrate with two surfaces opposite to each other;

respectively forming the two intermediate layers on the two surfaces by a sputtering process with a metal material selected from one of nickel, vanadium, chromium, aluminum, and zinc or a combination of nickel, vanadium, chromium, aluminum, and zinc, wherein a reduced ohmic contact is formed between each intermediate layer and the ceramic substrate;

respectively forming the two electrode layers on the two intermediate layers by a spray-forming process with a metal material selected from one of zinc, copper, tin, and nickel or a combination of zinc, copper, tin, and nickel;

connecting each electrode layer to a lead wire; and enclosing the ceramic substrate, the two electrode layers, and top portions of the two lead wires with an insulating layer.

9. The method as claimed in claim 8, wherein a thickness of each electrode layer is under 10 μm.

10. The method as claimed in claim 8, wherein a thickness of each intermediate layer is in a range of 0.1 to 0.5 μm.

* * * * *